US005638552A

United States Patent [19]

Fujima

[11] Patent Number: 5,638,552

[45] Date of Patent: Jun. 17, 1997

[54] DIVING FACE MASK

[75] Inventor: Taro Fujima, Higashi-Murayama, Japan

[73] Assignee: Tabata Co. Ltd., Tokyo, Japan

[21] Appl. No.: 535,443

[22] Filed: Sep. 28, 1995

[30] Foreign Application Priority Data

Oct. 7, 1994 [JP] Japan ..... 6-244192

[51] Int. Cl.[6] ..... A61F 9/02

[52] U.S. Cl. ..... 2/428; 2/441; 2/443

[58] Field of Search ..... 2/428, 430, 429, 2/441, 443

[56] References Cited

U.S. PATENT DOCUMENTS 1,565,890 12/1925 Baker ..... 2/441

1,674,728 6/1928 Lacasse ..... 2/441

1,751,024 3/1930 Baker ..... 2/441

5,345,615 9/1994 Garofalo ..... 2/430

5,479,917 1/1996 Hsieh ..... 2/428 X

*Primary Examiner*—Peter Nerbun

*Attorney, Agent, or Firm*—Lowe, Price, LeBlanc & Becker

[57] ABSTRACT

A diving face mask comprising a pair of front lenses detachably engaged in lens holding portions of an outer peripheral frame and, annular inner peripheral frames to be snapped in the lens holding portions so as to bear against front surfaces of the lenses, said annular inner peripheral frames being cut away partially in the circumferential direction thereof and therefore being discontinuous circumferentially.

4 Claims, 8 Drawing Sheets

DIVING FACE MASK

BACKGROUND OF THE INVENTION

The present invention relates to a diving face mask a diver puts on his or her face during diving such as skindiving or scuba-diving and more particularly to such a diving face mask allowing a lens exchange to be easily achieved.

FIG. 8 in the accompanying drawings is a perspective front view showing a diving face mask 100 of prior art as partially exploded. The mask 100 comprises a pair of transversely opposite front lenses 2, a main frame 103 having a front section to which the lenses 2 are detachably attached and a rear section adapted to be tightly put over a wearer's face, and a strap 4 attached to the main frame 103 so as to be releasably fastened around the wearer's head. The main frame 103 comprises a lens frame 105 of hard plastic and a skirt 6 of soft rubber. The lens frame 105 comprises an outer peripheral frame 8 having a pair of transversely opposite lens holding portions 7, a pair of inner peripheral frames 109 (referred to also as lens frames) adapted to bear against the front surfaces of the lenses 2 snapped in the holding portions 7 and a frame holding member 110 detachably mounted on a central part of the outer peripheral frame 8.

Each inner peripheral frame 109 is an annular member of substantially same contours as the holding portion 7 and has at desired locations along its outer periphery a convex engaging portion 131 adapted to be engaged with a concave engaging portion 19 provided in the inner peripheral surface of the holding portion 7 and a knob section 101 extending towards a central front surface of the outer peripheral frame 8.

With this mask 100 of prior art, the convex portion 131 snaps into the concave portion 19, on one hand, and a rear surface of the inner peripheral frame 109 bears against the front surface of the lens 2, on the other hand, as the inner peripheral frame 109 is fixed into the holding portion 7 after the lens 2 has been fixed thereinto, so that the lens 2 is prevented from slipping off from the holding portion 7. Then the frame holding member 110 covers the knob section 101 of the inner peripheral frame 109 as the frame holding member 110 is mounted on the outer peripheral frame 8 and, in consequence, the member 110 functions to protect the knob section 101 against being exposed to foreign substances. To perform a desired operation of lens exchange for the mask 100 assembled in this manner, the frame holding member 110 is removed, then a blade of a screw driver is inserted between the inner peripheral frame 109 and the outer peripheral frame 8, the inner peripheral frame 109 is yielded inwards radially of the frame 109 by the blade so that the convex portion 131 and the concave portion 19 are disengaged from each other and the inner peripheral frame 109 is pulled with the knob section 101 by hand.

To disengage the inner peripheral frame from the mask of prior art as has been mentioned above, not only an operating tool such as the screw driver but also a skill of a wearer is required. So it is difficult for an unskilled wearer to exchange a lens.

In view of the above-mentioned problem, it is a principal object of the invention to solve the above-mentioned problem by cutting away the inner peripheral frame partially in its circumferential direction so that the frame can be deformed inwards radially thereof.

SUMMARY OF THE INVENTION

To achieve the object set forth above, the invention broadly resides in a diving face mask comprising a pair of transversely opposite front lenses; a lens frame including a pair of transversely opposite lens holding portions to which said pair of lenses are detachably attached from the front, an outer peripheral frame having a central connector portion interposed between said holding portions and annular inner peripheral frames detachably snapped in said holding portions from the front so as to bear against the front surfaces of said lenses; a cylindrical skirt extending rearwards from said lens holding portions; and a strap attached to said outer peripheral frame and adapted to be fastened around a wearer's head; wherein each of said inner peripheral frames is cut away between circumferentially first and second locations and therefore discontinuous circumferentially thereof.

Preferably, said inner peripheral frame has, adjacent said first location, a portion extending towards a front surface of said central connector portion and has, adjacent said second location, a tenon or a mortise extending in front and in rear of said mask so that the tenon or the mortise of said inner peripheral frame is engageable with the mortise or the tenon, respectively, provided on a peripheral surface of said holding portion. Preferably, said outer peripheral frame has a frame holding member adapted to be disengageably engaged with said central connector portion so that said holding member can bear against said inner peripheral frame at said extending portion and adjacent the second location from the front.

With a diving face mask according to the invention arranged as has been described hereinabove, the annular inner peripheral frame is circumferentially discontinuous between the first and second locations so that the frame can be deformed adjacent these locations inwards radially thereof, i.e., in the direction away from the peripheral surface of the holding portion. Accordingly, the inner peripheral frame can be easily disengaged from the outer peripheral frame.

PREFERRED EMBODIMENTS OF THE INVENTION

Figure 1:
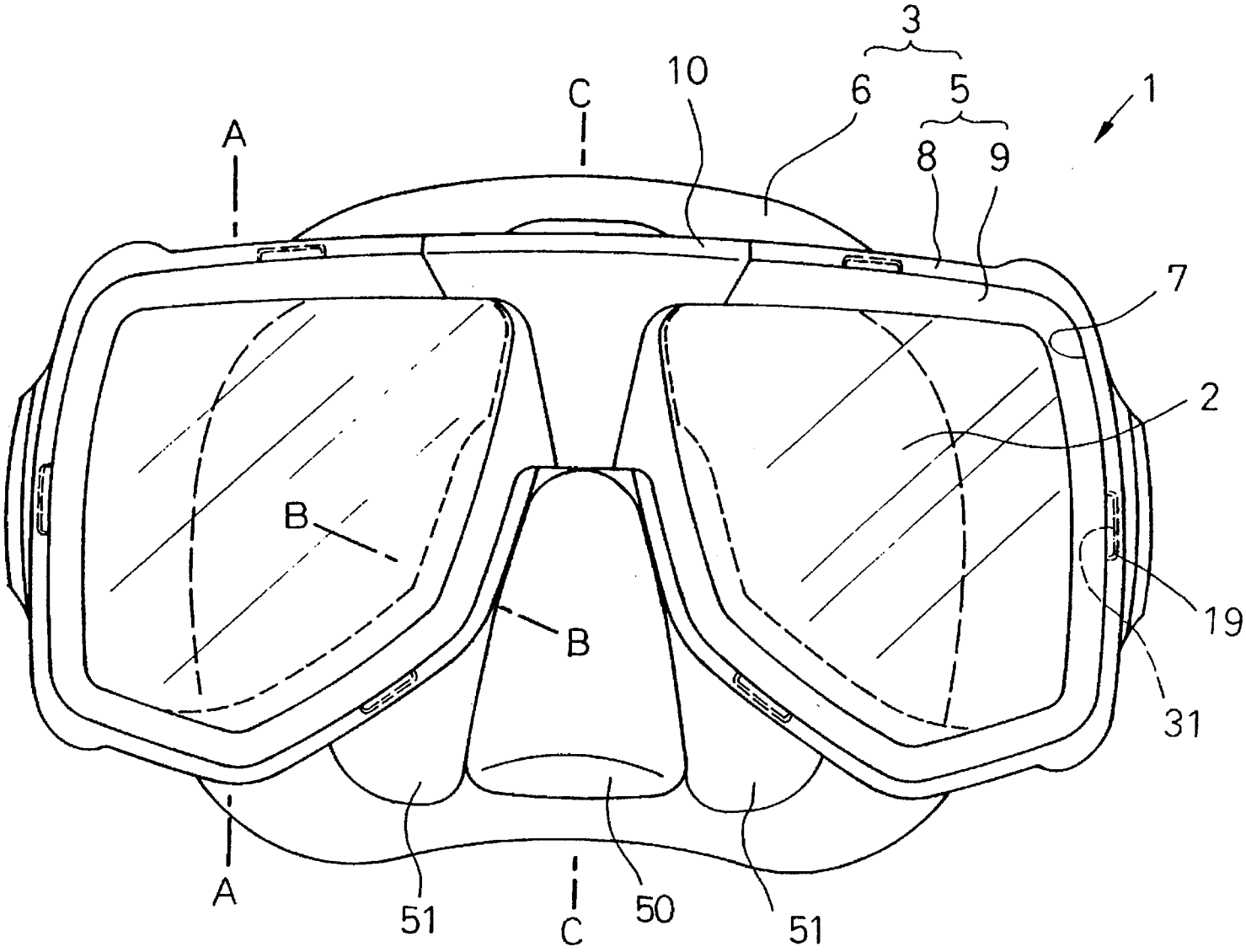
FIG. 1 is a front view showing an embodiment of a diving face mask according to the invention.

Referring to FIGS. 1 through 7, a mask 1 is transversely symmetric and comprises a pair of front lenses 2, a main frame 3 having a front section adapted to be engaged with the lenses 2 and a rear section adapted to be tightly put over a wearer's face, and a strap 4 attached to the main frame 3 so as to be releasably fastened around the wearer's head.

The lenses 2 are made of plastic or glass and detachably mounted in water-tight manner on the main frame 3 from the front thereof.

The main frame 3 comprises a lens frame 5 of hard plastic and a cylindrical skirt 6 of soft rubber or plastic. The lens frame 5 comprises an outer peripheral frame 8 having a pair of transversely symmetric lens holding portions 7, a pair of transversely symmetric inner peripheral frames 9 adapted to snap around the lenses 2 and the lens holding portions 7 from the front of the lenses 2 in order to protect the lenses 2 against slipping off from the outer peripheral frame 8, and a frame holding member 10 detachably mounted on a central part of the outer peripheral frame 8 so as to protect the inner peripheral frame 9 against slipping off from the outer peripheral frame 8.

Figure 2:
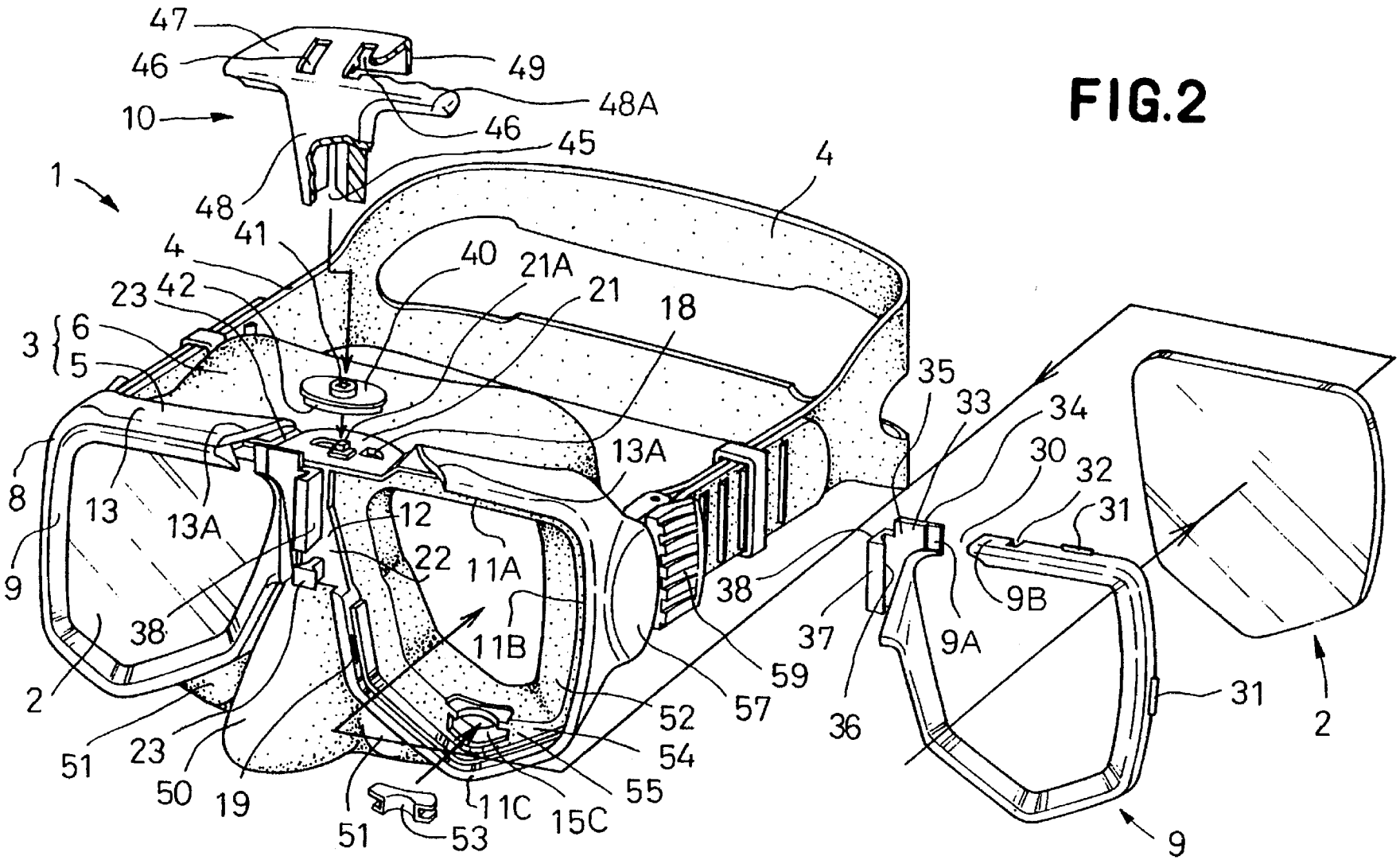
FIG. 2 is a perspective view of the mask shown by FIG. 1 as partially exploded.
Figure 3:
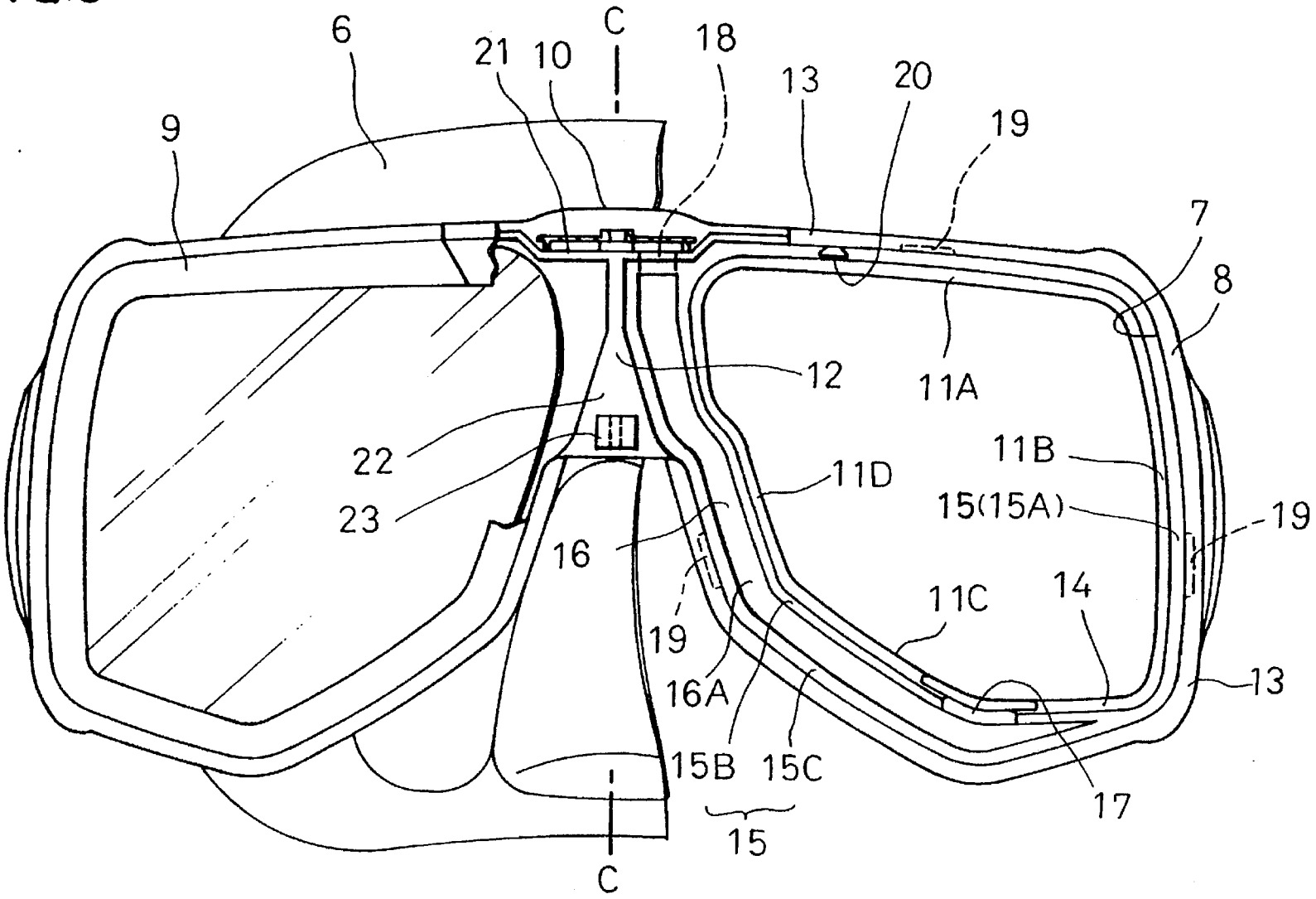
FIG. 3 is a front view similar to FIG. 1 but as partially broken away.

The outer peripheral frame 8 comprises, as will be best seen in FIGS. 2 and 3, a central connector portion 12 interposed between the right- and left-hand holding portions 7, peripheral walls 13 defining each holding portion 7 and extending in front and in rear of the mask 1, and inner flange portions 14 inwardly extending from the inner peripheral surfaces of the peripheral walls 13 along lines defined adjacent the front ends thereof. The respective flange portions 14 are provided on their front surfaces with annular ribs 15 against which front edges of the skirt 6 are pressed. Each rib 15 comprises a single rib 15A extending along a top 11A and a lateral side 11B of the outer peripheral frame 8 and a pair of ribs 15B, 15C branched from the rib 15A and parallelly extending along a bottom 11C and an inner side lid of the outer peripheral frame 8. The flange portion 14 has its recessed front surface 16A between the ribs 15B and 15C so as to define together with the ribs 15B and 15C a drainage groove 16. The groove 16 has its lower end communicating with the interior of the main frame 3 through a first opening 17 formed by partially cutting away the rib 15B along the bottom 11C of the outer peripheral frame 8 and its upper end communicating with a second opening 18 extending through the connector portion 12 to the exterior of the mask 1 as will be described later. The inner surface of each peripheral wall 13 is provided, at desired locations more adjacent to the front end thereof than the flange portion 14 is, with concave engaging portions 19 and a tenon 20 extending forwardly of the mask 1, through which the inner peripheral frame 9 can be engaged with the peripheral wall 13.

The central connector portion 12 of the outer peripheral frame 8 comprises a substantially horizontal top side 21 located at the level of the top 11A and rearwardly arching, and a substantially vertical, smooth, inverted V-shaped front side 22 extending downwards. The top side 21 is centrally provided with a rectangular boss 21A which is, in turn provided on either side thereof with a pair of second openings 18 fluid-communicating with the right- and left-hand grooves 16, respectively. A transversely long elliptical purge valve 40 centrally formed with a rectangular through-hole 41 substantially corresponding in its size to the boss 21A is engaged on the boss 21A so that the purge valve 40 covers the second openings 18 with a peripheral wall 42 extending downwards being tightly in contact with the top side 21. Transversely opposite side edges of the top side 21 are configured in conformity with the corresponding side edges of the frame holding member 10 and located at a level lower than the peripheral wall 13 so that the frame holding member 10 is situated so as to form a smooth surface continuous with the peripheral wall 13 when the frame holding member 10 is mounted on the outer peripheral frame 8. A tenon 23 vertically extending along the center line C—C of the mask 1 extends forwards from the lower half of the front side 22 and this lower half is continuous with each peripheral wall 13. The front side 22 is located rewardly of the front end of the peripheral walls 13 so that the frame holding member 10 is situated so as to form a smooth surface continuous with the peripheral wall 13 when the frame holding member 10 is mounted on the outer peripheral frame 8.

As will be best seen in FIG. 2, each inner peripheral frame 9 is substantially annular and has a cut-away section 30 extending circumferentially of the annulus. Circumferentially opposite first and second end portions 9A, 9B defining the cut-away section 30 therebetween are elastically deformable inwardly of the annulus, i.e., in the direction such that the inner peripheral frame 9 has its diameter reduced thereby. The outer peripheral surface of the inner peripheral frame 9 is provided with convex engaging portions 31 and a mortise 32 corresponding to the concave engaging portions 19 and the tenon 20, respectively, of the outer peripheral frame 8. The mortise 32 and the tenon 20 are to be engaged with each other to prevent the inner peripheral frame 9 from being inwardly deformed towards the lens holding portion 7 and they are preferably located adjacent the cut-away section 30. From the outer peripheral surface of the inner peripheral frame 9 adjacent the center line C—C, a lock tongue 33 extends to the center line C—C. The lock tongue 33 has a smooth rear surface 34 destined to bear against the front side 22 of the connector portion 12. The lock tongue 33 is provided in its front surface 35 with a tenon half 37 comprising a longitudinal projection configured to define a groove 36 presenting a V-shaped cross-section extending in parallel to the center line C—C. When the right- and left-hand inner peripheral frames 9 are engaged with the respective lens holding portions 7, side walls 38 of the respective right- and left-hand tenon halves 37 abut against each other along the center line C—C, thereby forming a tenon 39 (see FIG. 6) which presents the same cross-section as that of the tenon 23 on the central connector portion 12 and is vertically aligned with the tenon 23 (on the center line C—C) (see FIG. 7).

Figure 7:
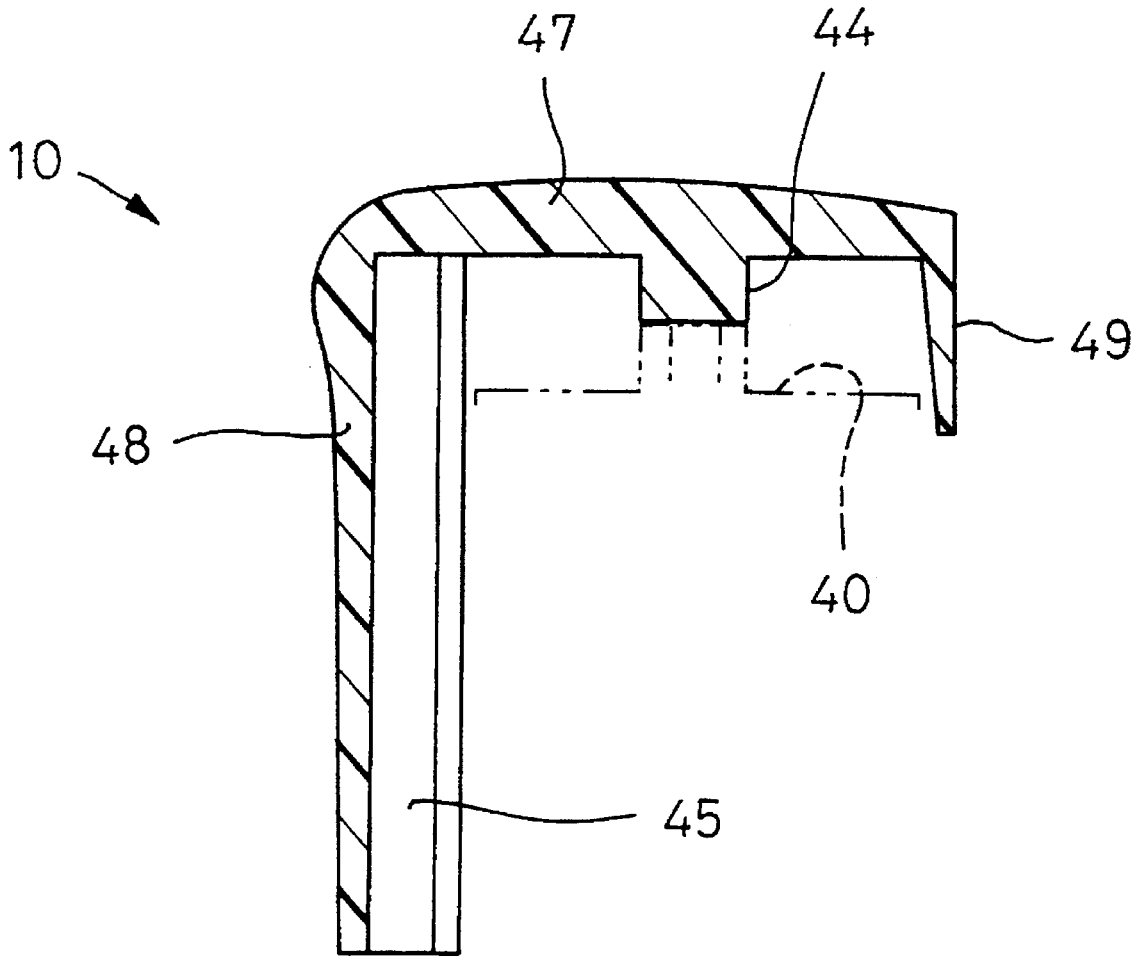
FIG. 7 is a perspective view showing a central part of an outer peripheral frame with the frame holding member being disengaged.
Figure 8:
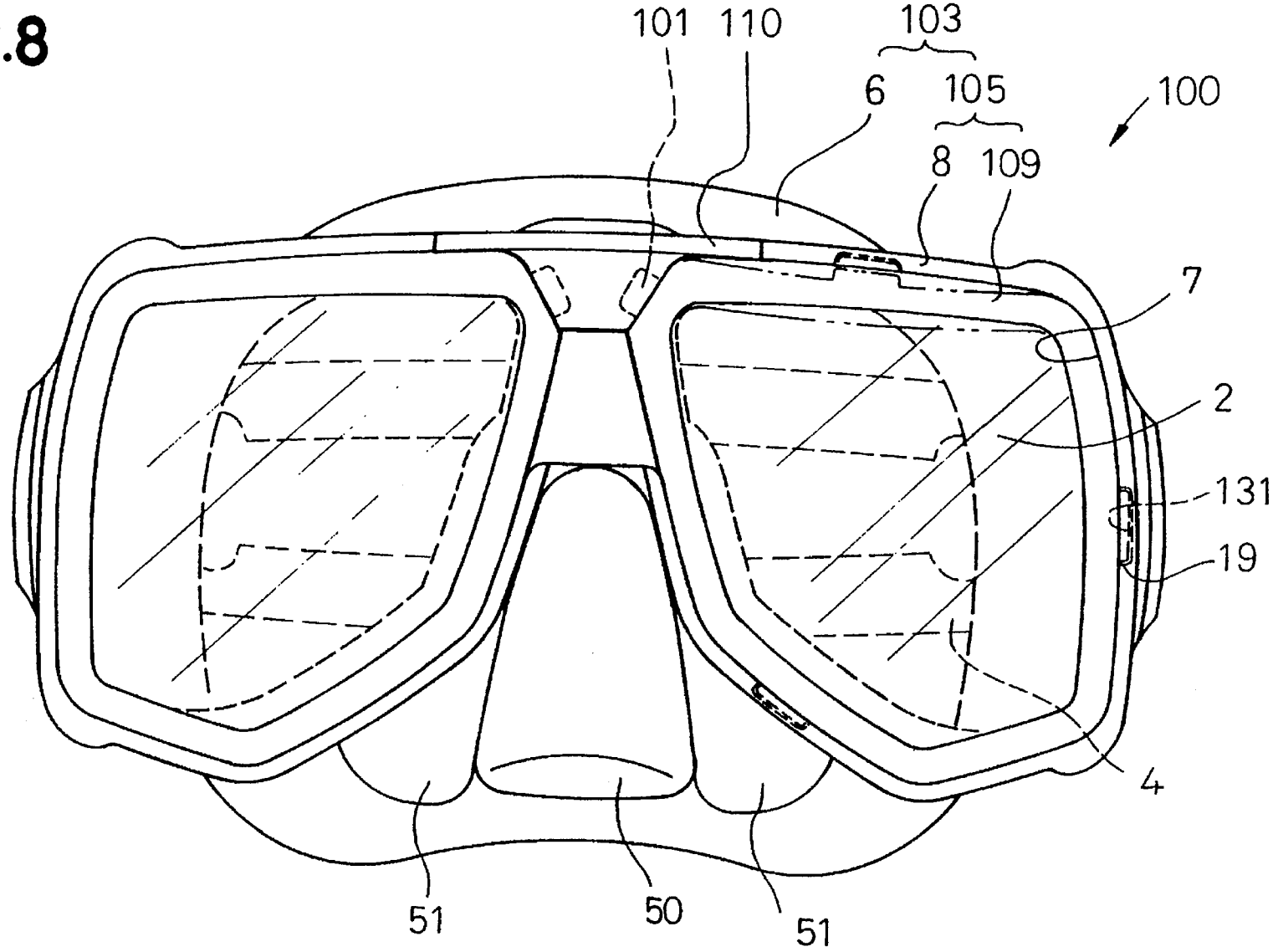
FIG. 8 is a front view exemplarily showing a diving face mask of prior art.

Referring to FIGS. 2 and 7, the frame holding member 10 comprises a top portion 47, a front portion 48 and a rear portion 49. The top portion 47 lines between the opposite top side edges 13A of the right- and left-hand peripheral walls 13 of the outer peripheral frame 8, and covers the top side 21 of the central connector portion 12 so as to protect the purge valve 40 from possible contact with foreign substances. A boss 44 extends downwardly from the inner surface of the top portion 47 towards the boss 21A of the top side 21 and bears against the purge valve 40 from above to prevent the purge valve 40 from slipping off from the boss 21A. There are provided a pair of through-holes 46 on either side of the boss 44 to assure air- and water-communication between interior and exterior of the frame holding member 10. The front portion 48 presents a T-like shape as viewed from the front (see FIG. 1) and can completely cover the front side 22 of the central connector portion 12. A mortise 45 vertically extends in the inner surface of the front portion 48 so that this mortise 45 may be slidably engaged with the tenons 23, 39 along the center line C—C to attach or detach the frame holding member 10 to the central connector portion 12. The rear portion 49 of the member 10 really comprises a low wall extending in opposite directions from the center of the frame holding member 10, of which the inner surface is configured substantially in conformity with the rear wall of the top side 21 of the frame 8. The front portion 48 and the rear portion 49 hold therebetween both the top side 21 and the lock tongues 33 of the respective inner peripheral frames 9 from front and rear of the mask 1. At the same time, wings 48A of the front portion 48 bear against the second ends 9B of the respective inner peripheral frames 9 from the front thereof and consequently these second ends 9B do not disengage from the tenons 20.

Figure 4:
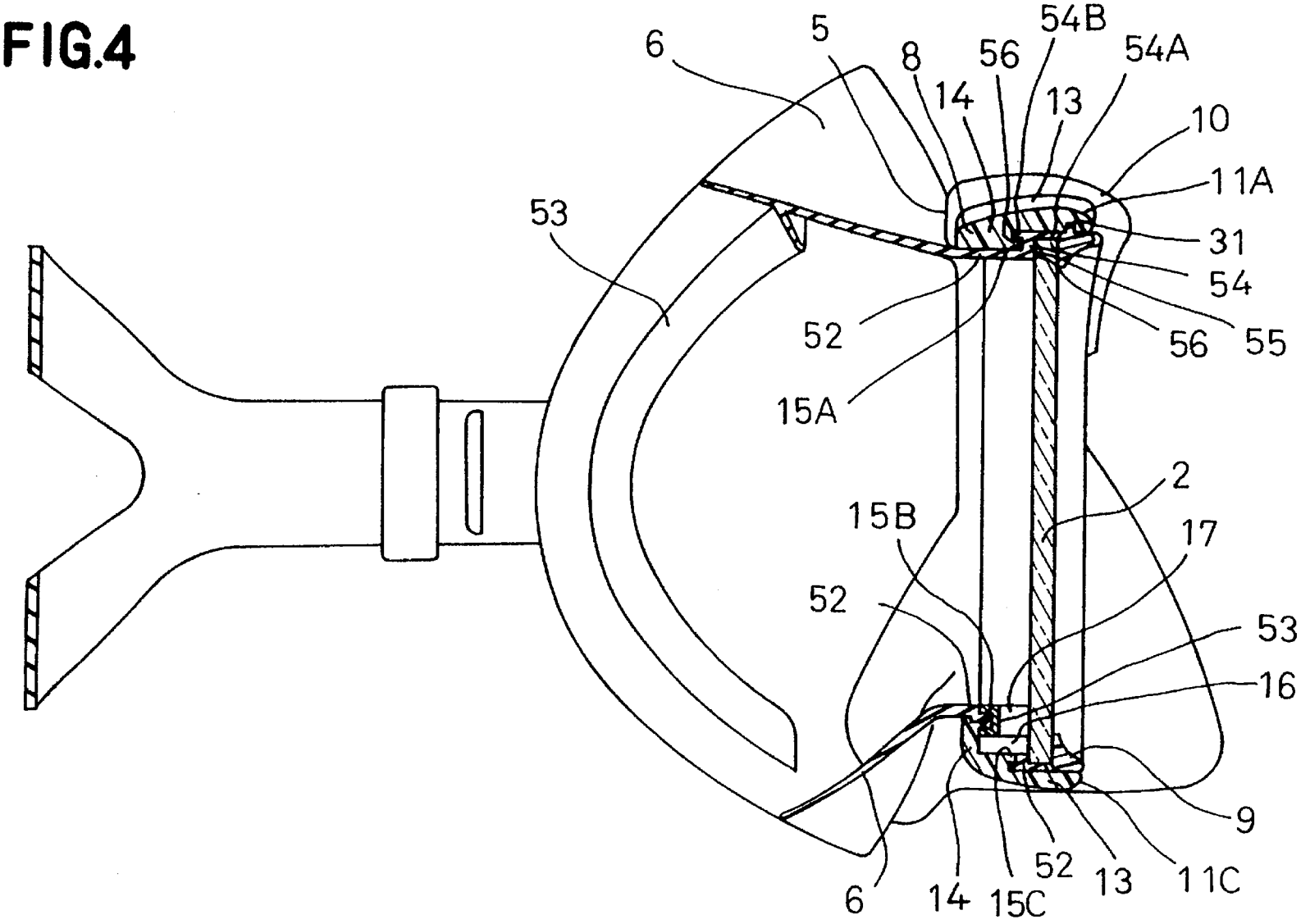
FIG. 4 is a sectional view taken along a line A—A in FIG. 1.
Figure 5:
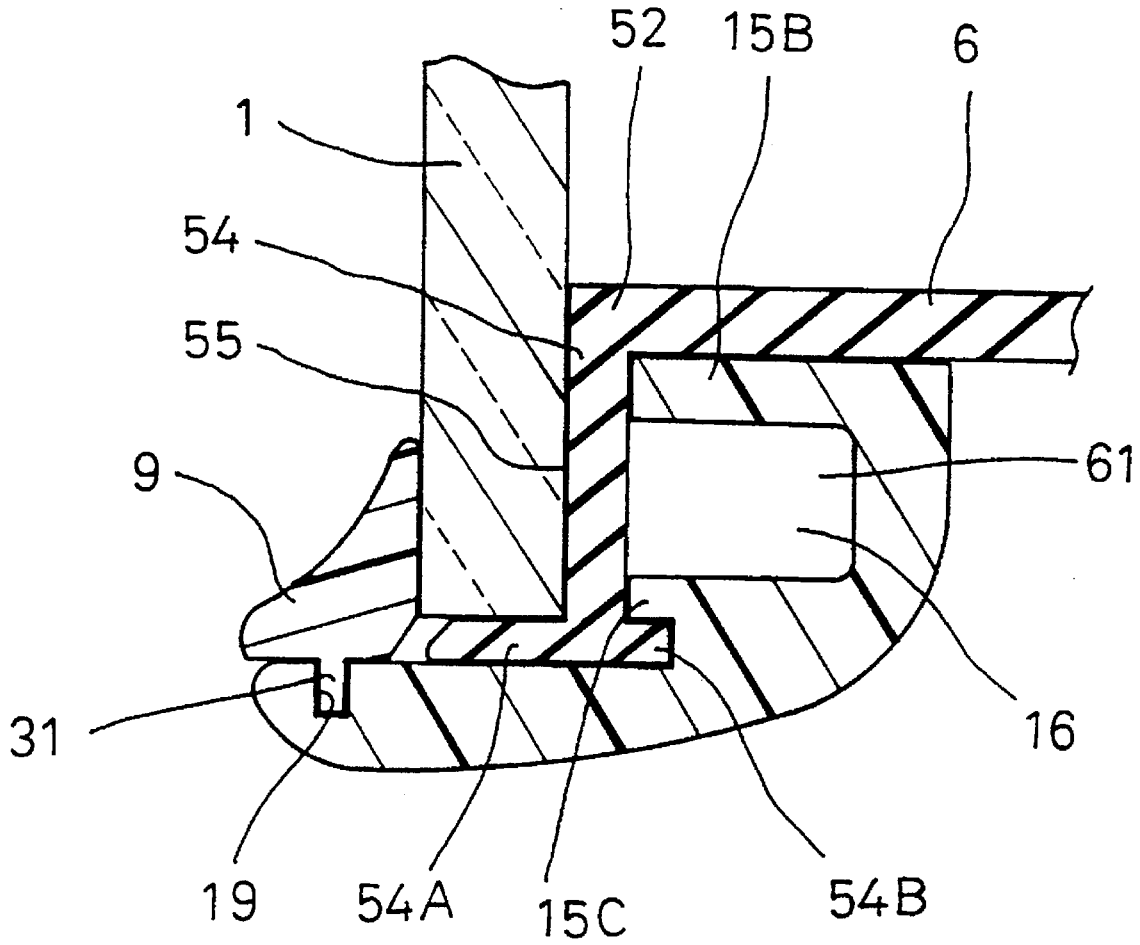
FIG. 5 is a sectional view taken along a line B—B in FIG. 1.
Figure 6:
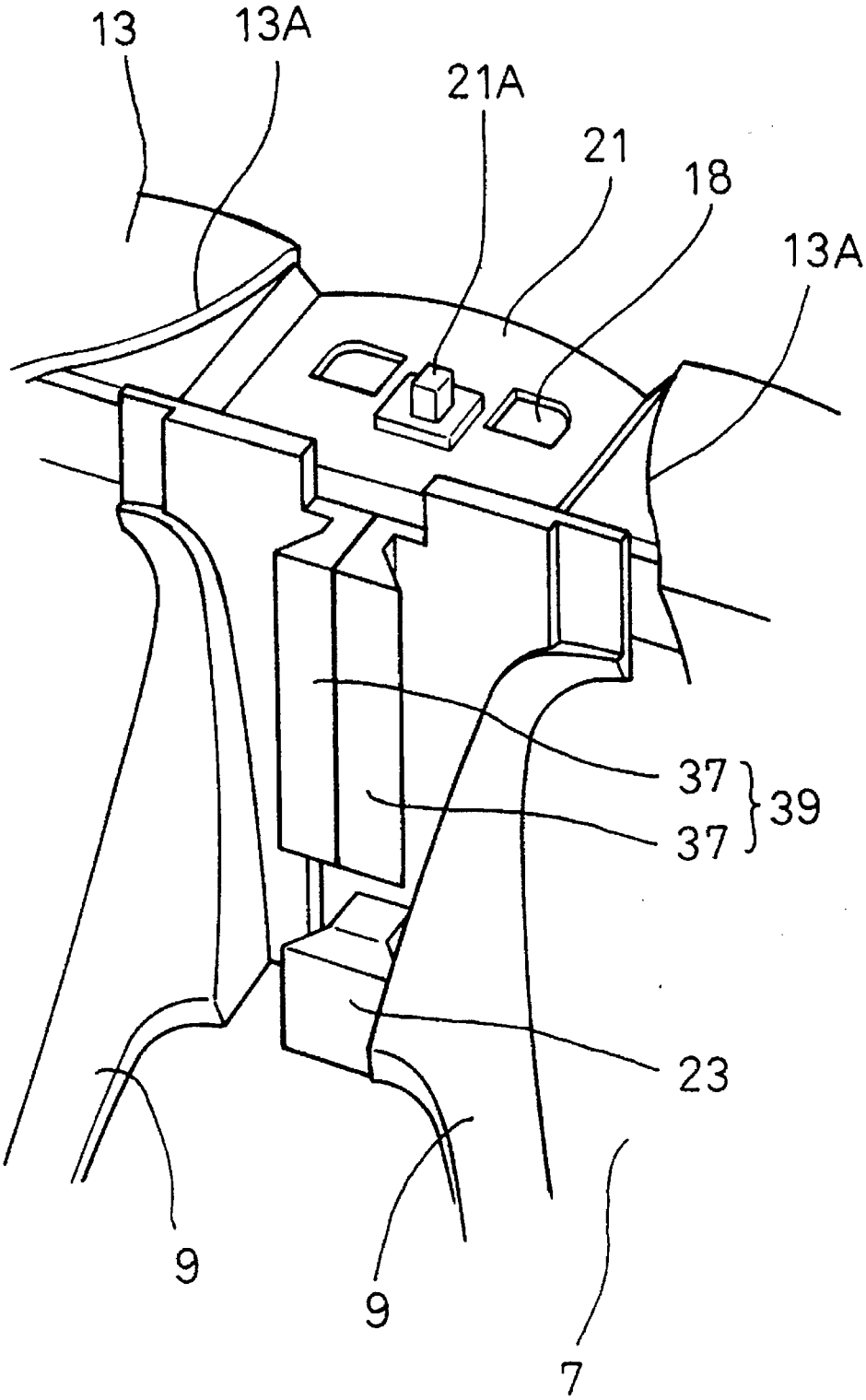
FIG. 6 is a sectional view of the frame holding member as taken along the center line thereof.

Referring to FIGS. 2, 4 and 5, the skirt 6 includes a nose covering portion 50 centrally extending forwards so as to cover a wearer's nose and, on either side of this nose covering portion 50, the skirt 6 has a pair of nose pinching portions 51 adapted to receive wearer's fingers inserted thereto and a pair of annular sealing portions 52 serving to maintain water-tightness between each lens 2 and the main frame 5. As shown in details by FIGS. 4 and 5, each sealing portion 52 has a flange-like portion 54 on its front end, of which the front surface 55 bears against the rear side of the lens 2 and the rear surface 56 bears against the ribs 15A through 15C of the outer peripheral frame 8. Accordingly, a water-tightness is established between the lens 2 and the ribs 15A through 15C by a cushioning effect of the flange-like portion 54 when the inner peripheral frame 9 is snapped into the outer peripheral frame 8. However, each sealing portion 52 is partially cut away along a region corresponding to the first opening 17 of the outer peripheral frame 8 so that the groove 16 communicates with the interior of the main frame 3, more specifically with a space behind the lens 2 through the first opening 17 even after the skirt 6 has been mounted on the lens frame 5. It should be understood that, even in the region of the first opening 17 corresponding to the cut-away section of the rib 15B along which the rib 15B stays away from the rear surface of the lens 2, the water-tightness is assured by means of a member 53 adapted to nip the sealing portion 52 and the rib 15B put one on another from above and below.

Structural details of the skirt 6 and the groove 16 will be apparent from FIGS. 4 and 5. Referring to FIG. 4, the sealing portion 52 of the skirt 6, the lens 2 and the inner peripheral frame 9 are engaged, in this order, with the associated holding portion 7. The flange-like portion 54 of the skirt 6 bears against the rib 15A along the top 11A and an outer peripheral edge portion 54A of the flange-like portion 54 is interposed as buffer means between the inner peripheral surface of the holding portion 7 and the peripheral surface of the lens 2. Another outer peripheral edge portion 54B of the flange-like portion 54 is interposed between the inner peripheral surface of the lens holding portion 7 and the rib 15A to prevent the flange-like portion 54 from shifting inwards radially of the holding portion 7. The inner peripheral frame 9 snaps into the outer peripheral frame 8 by the convex engaging portions 31. At the bottom 11C of the outer peripheral frame 8, the groove 16 fluid-communicates with the interior of the main frame 3.

As will be best seen in FIG. 5, the flange-like portion 54 of the skirt 6 tightly bears against the ribs 15B, 15C and thereby defines together with the groove 16 a tubular water purge channel 61 presenting a rectangular cross section. This tubular water purge channel 61 extends upwards along the ribs 15B, 15C and fluid-communicates with the second opening 18 extending through the top side 21 of the connector portion 12 (see FIG. 3).

There are provided a vertical shaft (not shown) and a strap adjuster 59 on either side of the outer peripheral frame 8, respectively, for effectively fastening the strap 4 around the wearer's head.

Procedure to assemble the mask 1 of the arrangement is started by inserting the sealing portion 52 of the skirt 6 into the lens holding portion 7 from behind the lens frame 5 with the rear surface of each front flange-like portion 54 being brought in close contact with the ribs 15A, 15B, 15C and then the sealing portion 52 and the rib 15B are nipped by the member 53. Now each lens 2 is fixed into the lens holding portion 7 from the front of the mask 1, and successively each inner peripheral frame 9 is snapped into the outer peripheral frame 8 from the front. After the purge valve 40 has been mounted on the boss 21A, the mortise 45 of the frame holding member 10 is successively engaged on the tenons 39, 23 so that the top side 21 of the central connector portion 12 as well as the lock tongue 33 of each inner peripheral frame 9 may be securely held between the front and rear portions 48, 49 of the frame holding member 10. When it is desired to disassemble the mask 1 for exchange of the lens 2 or cleaning of the groove 16, the procedure for assembling may be inversely followed. It should be understood that, in order to take the lens 2 off, the first end 9A of each inner peripheral frame 9 may be moved forwardly of the mask 1 so as to be disengaged from the tenon 20, and then the first end 9A and/or the second end 9B may be elastically deformed inwards radially of the inner peripheral frame 9. In this manner, the inner peripheral frame 9 can be easily unsnapped.

With the diving face mask according to the invention, an inner peripheral frame can be easily disengaged from an outer peripheral frame by deforming inwards radially the inner peripheral frame adjacent a first end and/or a second end by hand because this annular inner peripheral frame is cut away between the first and second ends so as to be discontinuous circumferentially thereof. Therefore, a wearer is not required to prepare any special tool for disengaging the inner peripheral frame and neither preliminary knowledge nor experience is necessary.

What is claimed is:

1. A diving face mask comprising a pair of transversely opposite front lenses; a lens frame having a pair of transversely opposite circular lens holding portions to which said pair of lenses are detachably attached from the front of the mask, an outer peripheral frame having a central connector portion to be interposed between said pair of lens holding portions, and inner peripheral frames to be detachably snapped into said lens holding portions from the front so as to bear against front surfaces of said lenses; a cylindrical skirt extending rearwards from said lens holding portions; and a strap attached to said outer peripheral frame and adapted to be fastened around a wearer's head; wherein each of said inner peripheral frames is substantially annular and discontinuous circumferentially.

2. The mask according to claim 1, wherein each inner peripheral frame is discontinuous between first and second ends thereof and has, adjacent said first end, a portion extending towards a front surface of said central connector portion and has, adjacent said second end, a tenon or a mortise extending in front and in rear of said mask so that the tenon or the mortise of said inner peripheral frame is engageable with a mortise or a tenon, respectively, provided on a peripheral surface of said lens holding portion.

3. The mask according to claim 2, wherein said outer peripheral frame has a frame holding member adapted to be disengageably engaged with said central connector portion so that said holding member can bear against said inner peripheral frame at said portion extending towards the central connector portion and adjacent the second end of the inner peripheral frame from the front of the mask.

4. A diving mask comprising a pair of transversely opposite front lenses, each of said lenses having mutually substantially parallel front and rear peripheral surfaces, and a lens frame for holding said pair of lenses;

wherein said lens frame includes:

a pair of transversely opposite circular lens holding portions to which said pair of lenses are detachably attached from the front of said mask; and inner peripheral frames being substantially annular and discontinuous circumferentially and being elastically deformable inwardly thereof, each said inner peripheral frame being detachably attached under the elastic deformation thereof to said each lens holding portion from the front, wherein each said inner peripheral frame bears against said front peripheral surface of a respective one of said lenses.

* * * * *